US007311098B2

(12) United States Patent
Gallops, Jr.

(10) Patent No.: US 7,311,098 B2
(45) **Date of Patent: *Dec. 25, 2007**

(54) ZERO CENTER OF MASS ARCHERY CAM

(75) Inventor: Henry M. Gallops, Jr., Gainesville, FL (US)

(73) Assignee: Bear Archery, Inc., Evansville, IN (US)

( * ) Notice: Subject to any disclaimer, the term of this patent is extended or adjusted under 35 U.S.C. 154(b) by 206 days.

This patent is subject to a terminal disclaimer.

(21) Appl. No.: 11/221,117

(22) Filed: Sep. 7, 2005

(65) Prior Publication Data

US 2006/0000463 A1 Jan. 5, 2006

Related U.S. Application Data

(63) Continuation of application No. 10/971,272, filed on Oct. 22, 2004, now Pat. No. 6,976,484.

(60) Provisional application No. 60/585,764, filed on Jul. 6, 2004, provisional application No. 60/576,664, filed on Jun. 3, 2004.

(51) Int. Cl.
*F41B 5/10* (2006.01)

(52) U.S. Cl. ..... 124/25.6; 124/900

(58) Field of Classification Search ..... 124/25.6, 124/900

See application file for complete search history.

(56) References Cited

U.S. PATENT DOCUMENTS 5,368,006 A 11/1994 McPherson
5,749,351 A 5/1998 Allshouse et al.
5,809,982 A 9/1998 McPherson
5,901,692 A 5/1999 Allshouse et al.
5,921,227 A 7/1999 Allshouse et al.
5,996,567 A 12/1999 McPherson
6,035,841 A 3/2000 Martin et al.
6,039,035 A 3/2000 McPherson
6,105,565 A 8/2000 Martin et al.
6,257,219 B1 7/2001 McPherson
6,267,108 B1 7/2001 McPherson et al.
6,382,201 B1 5/2002 McPherson et al.
6,976,484 B1 * 12/2005 Gallops, Jr. ..... 124/25.6

* cited by examiner

*Primary Examiner*—John A. Ricci
(74) *Attorney, Agent, or Firm*—Woodard, Emhardt, Moriarty, McNett & Henry LLP

(57) ABSTRACT

One preferred embodiment of the present invention provides a cam having an axle location for mounting the cam to an archery bow, where the center of mass of the cam is substantially coaxial with the axle location. Preferable the cam has an eccentric geometric rotation profile with regard to a rotation axis, typically an irregular geometry with a non-centered axle location, or a circular profile with an axle location offset from the center of the circular profile. The mass of the cam is balanced to have an effectively equal mass distribution around the axle location. In an alternate preferred embodiment, the cam has a balanced center of mass aligned with the axle location in an X-Y orientation, and may also have a balanced center of mass through the thickness of the cam in an X-Z or Y-Z orientation.

24 Claims, 13 Drawing Sheets

ZERO CENTER OF MASS ARCHERY CAM

This application is a continuation application of and claims priority to application Ser. No. 10/971,272, filed Oct. 22, 2004 now U.S. Pat. No. 6,976,484, which claims priority to and incorporates by reference U.S. Provisional Application Ser. No. 60/585,764 filed Jul. 6, 2004 and U.S. Provisional Application Ser. No. 60/576,664, filed Jun. 3, 2004.

FIELD OF THE INVENTION

The present invention relates to archery bows, and in preferred embodiments provides a cam for a compound archery bow, a compound bow and cam, and a method of making and arranging a cam.

BACKGROUND OF THE INVENTION

The present invention deals primarily with compound archery bows, generally including a bow frame and a cable system on the frame mounted to at least two rotational elements such as wheels. Early compound bow wheels or cams were basically a round wheel with the axle hole located off center to produce let-off as the bow is pulled to full draw. These eccentrically mounted wheels have a mass center off-set from the axle hole. When rotated about an axle, the inertia of the off-center mass produces a kick which causes the rest of the system to gyrate. This causes a kick or vibration/shock movement which is imparted to the bow and archer when the bow is shot. This kick can disrupt the archer's aim or the archer absorbs this energy as opposed to the energy being transferred to the arrow or the arrow's flight.

As bow efficiencies increased and the need for higher performance and velocities were required, the off-center mass kick of eccentric mass cams was amplified. One response to this vibration/shock was to use a sacrificial dampening device. One of the first devices designed was a forward stabilizer, which mounted on the front portion of the riser. When the bow was shot, a portion of the excess vibration was absorbed by the stabilizer. As time evolved, other types of dampening systems were designed including devices that were mounted in the riser for the purpose of absorbing vibration. These dampening systems do not absorb all of the vibration.

Another method of dissipating the overall bow kick was the use of a perimeter weight in the cam to offset limb kick. Since the limbs travel in a forward direction when shot, there was a forward movement and inertia imparted to the bow, away from the archer. By mounting a weight on the outside perimeter of the cam, in a fashion that moved in the opposite direction of the limb as the bow was shot, the effects of the limb movement were partially counteracted or cancelled.

Another effort to cancel the bow's kick or forward movement was found in the geometry of the bow. By orienting the limbs in such a way that the limb tip movement was closer to vertical movement, it was discovered that some of the forward limb kick was eliminated. When the bow is pulled to full draw, the limbs were pulled towards each other as opposed to moving towards the archer. When the bowstring was released, the limb tips would move in a near vertical direction. By creating this opposing movement, the limbs and cams somewhat cancelled each other, creating a more pleasurable shooting bow. Nevertheless, even when the perimeter weighted cam and vertical limb technology were used together, the bow still typically had a kick.

An improved bow and cam are desired.

SUMMARY OF THE INVENTION

One preferred embodiment of the present invention provides a cam having an axle location for mounting the cam to an archery bow, where the center of mass of the cam is substantially coaxial with the axle location. Preferable the cam has an eccentric geometric rotation profile with regard to a rotation axis, typically an irregular geometry with a non-centered axle location, or a circular profile with an axle location offset from the center of the circular profile. The mass of the cam is balanced to have an effectively equal mass distribution around the axle location. In an alternate preferred embodiment, the cam has a balanced center of mass aligned with the axle location in an X-Y orientation, and may also have a balanced center of mass through the thickness of the cam in an X-Z or Y-Z orientation.

In certain embodiments of the present invention, by arranging, placing or reducing the weight/mass at one or more locations on the cam (FIG. 2), the effective center of mass can be zeroed to the centerline of the axle to reduce or eliminate this gyration or kick. In a preferred embodiment, a "zeroed" cam with a center of mass co-axial with the axle location will spin freely as a concentric wheel does on a central axis. The even distribution of mass around the axle eliminates the traditional kick or gyration upon bowstring release typically created by an eccentrically located axle hole.

In a preferred embodiment of the present invention, an archery bow encompasses an archery bow riser and a pair of bow limbs. Each bow limb has a proximal end and a distal end, with the proximal ends secured to the riser. At least one axle is mounted adjacent the distal end of one bow limb and a cam is eccentrically rotatably mounted on the axle. Additionally, a bowstring is extended between the distal ends of the limbs and configured to be fed outward from the cam when the archery bow is drawn wherein the cam has a center of mass aligned coaxially with the axle.

In another preferred embodiment of the present invention, a cam for an archery bow comprises a rotatable cam body for an archery bow. The cam body defines a profile and an axle location is defined through the cam body such that the cam body profile is eccentrically rotatable around the axle location. The center of mass of the cam body is substantially coaxial with the axle location.

In yet another preferred embodiment of the present invention, a dual-feed single-cam compound bow has a pair of flexible resilient bow limbs forming first and second distal bow limb ends with a riser connecting the proximal bow limb ends thereof and a drop-off cam journaled on an axle pin at the first distal bow limb end. The cam has eccentric peripheral groove portions wherein each groove portion is journaled on the axle pin. The cam has a side profile with a center of mass axis coaxial with the axle pin.

Additionally, the dual-feed single-cam compound bow includes of a pulley concentrically journaled at the second distal bow limb end and has a peripheral groove. An elongated cable has an intermediate portion trained around the concentric pulley to form two cable sections which extend between the pulley and the cam. One section forms a bowstring which has feed-out end portions at both ends thereof, and the other section forms a take-up portion at the pulley end thereof and a feed-out portion at the cam end thereof. The sections are both received in eccentric groove portions peripheral to the cam in a manner to provide a pair of feed-out sections extending from the cam toward the pulley. An anchor cable extends between the two limbs, with one end thereof fixed to the second bow limb end and the other anchor cable end fixed to the cam and trained in a take-up groove portion of the cam to produce controlled flexing of the bow limbs during the drawing of the bowstring.

In yet another preferred embodiment of the present invention, a cam for an archery bow includes a cam body for an archery bow wherein the cam body has a thickness and defines at least one cable path with the path defining a cam plane. An axle passage is defined through the cam body perpendicular to the cam plane, wherein at least one cable path is eccentric to the axle passage. In addition, the cam body has a geometrically unequal distribution of mass through the thickness of the cam body with respect to the axle passage and the center of mass of the cam body along the axis of the axle passage is located substantially at the midpoint of the axle passage.

In still yet another preferred embodiment of the present invention, a method of balancing a cam for an archery bow involves forming a cam body mountable on an archery bow defining an X-Y plane and defining at least one cable path. An axle location is defined on the body perpendicular to the X-Y plane such that the at least one cable path is eccentrically rotatable around the axle location, and the center of mass of the body is offset from the axle location. The center of mass of the body is adjusted in the X-Y plane so that the center of mass is coaxial with the axle location.

It is an object of certain preferred embodiments of the present inventions to provide an improved archery bow, cam and method.

Other objects of the embodiments of the present invention will be clear from the description, figures and claims herein.

DESCRIPTION OF PREFERRED EMBODIMENTS

Figure 1:
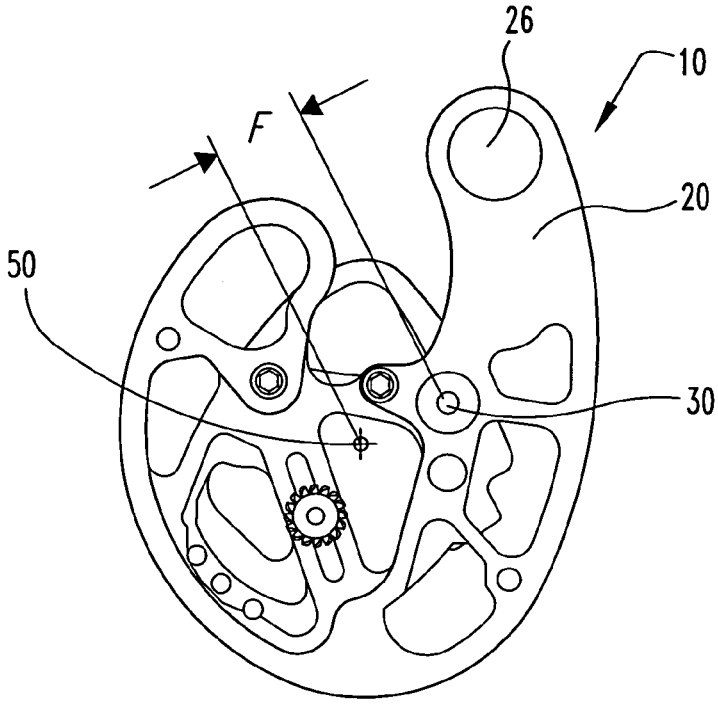
Fig. 1 (Prior Art)
FIG. 1 is a profile of a cam according to the prior art.

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

One preferred embodiment of the present invention provides a cam having an axle location for mounting the cam to an archery bow, where the center of mass of the cam is substantially coaxial with the axle location. Preferable the cam has an eccentric geometric rotation profile with regard to a rotation axis, typically an irregular geometry with a non-centered axle location, or a circular profile with an axle location offset from the center of the circular profile. The mass of the cam is balanced to have an effectively equal mass distribution around the axle location. In an alternate preferred embodiment, the cam has a balanced center of mass aligned with the axle location in an X-Y orientation, and may also have a balanced center of mass through the thickness of the cam in an X-Z or Y-Z orientation.

Typically a compound bow 200 (FIG. 3) includes a riser or handle 205, two limbs 207 extending from the riser with proximal ends 208 secured to the riser, rotational elements such as wheels, pulleys or cams mounted on axles 230 adjacent the distal ends 209 of the limbs, and a cable system 210 with a bowstring portion 212 arranged between the rotational elements on limb tips 209 opposite the riser. As the bowstring portion 212 of the cable system 210 is drawn and "let-out" by the rotational elements, the limb tips 209 resiliently and flexibly travel towards each other, storing energy in the limbs and are controlled and held by the cable system. When the bowstring is released, the limb tips spring back into place, taking up the cable system and imparting energy to an arrow nocked to the bowstring portion 212. The rotational elements generally rotate in one direction to let-out portions of the cable system, such as the bowstring when the bow is moved to a drawn position, and generally rotate in the opposite direction to take-up portions of the cable system and bowstring when the bowstring is released.

A compound bow typically has at least one cam defining an eccentric path within the cable system so that the force to draw the bowstring drops or is "let-off" as the bowstring is drawn. This drop-off effect preferably assists an archer to draw and hold the bow at a drawn position for a longer period of time, for example while aiming.

Generally a rotational element such as a cam defines a substantially planar X-Y direction, generally in longitudinal alignment with a bow and bowstring and generally encompassing the movement path of the bowstring as the bow is drawn and released. Although a cam may have a greater or lesser thickness, depending on the design and integral or mounted components, for example due to multiple grooves or modules, the axle location and X-Y center of mass lines referred to herein are generally substantially perpendicular to the X-Y plane of the cam and/or the length of the bow.

When considering a mass body, the body is defined as a matter of physics to have a "center of mass". The center of mass in three dimensions is defined at a point representing the mean position of the matter in the body. In another way of stating it, the center of mass of a body is the point that moves as though all of the mass were concentrated there and all external forces were applied there. The center of mass does not need to be a physically defined structure, and can be a virtual point calculated from the weighted mean of the mass portions of the body. The weighted mean accounts for the amount and specific gravity of each material used and its relative position. The center of mass is sometimes called the center of inertia.

From the perspective of a two-dimensional analysis, i.e. a defined plane, the center of mass is defined as a point representing the mean position of the weighted matter in the body with respect to that plane. A center of mass axis is perpendicular to the defined plane and passes through the center of mass point on the plane. References to the "center of mass" herein, when discussed in the context of a plane, are used interchangeably with the center of mass axis, unless specified otherwise or made clear in context.

Directions referred to herein, such as forwardly, rearwardly, vertically and horizontally are intended to be from the perspective of an archer holding an archery bow and are not intended to be absolute. The bow is considered to be held in a substantially vertical position for use, with the bowstring and riser generally considered vertical. Forwardly refers to the direction from the bowstring towards the riser in which direction the arrow is intended to leave the bow. Rearwardly refers to the direction extending from the riser towards the bowstring and the archer. Other directional references are intended to apply from this perspective.

In one preferred embodiment of the present invention, the mass of the cam is designed so that the X-Y center of mass is co-axial with the cam's axle. In certain specific embodiments, one or more masses are located, arranged or removed on the cam to "weight" or "zero" the cam in order to move the X-Y center of mass axis so it is effectively co-axial with the centerline of the cam's axle location.

In one prior art example (FIG. 1), an irregular or eccentric mass cam typically will have an irregular mass distribution offset with respect to the axle, causing the cam to change moments or gyrate as it rotates while the bowstring is being pulled to a full draw position to be released. This gyration causes a kick upon release of the bow string. Among other effects, the change in moment and angular force causes the cam's axis to attempt to precess and nutate around the desired cam rotation axis.

As an example, FIG. 1 shows a typical eccentric mass cam of the prior art. Cam 10 includes an irregular cam body 20, with an eccentrically located axle location such as axle hole 30. In this example, a perimeter weighted cam is used, meaning that a weight 26 is placed on the cam tip at the outside perimeter of the cam 10, such as described in U.S. Pat. No. 5,809,982 with the named inventor Mathew A. McPherson. In cam 10, the axis of the center of mass 50 is offset in relation to the axle hole 30. Typically, the center of mass 50 is offset a considerable distance F from the axle hole 30. The typical center of mass on this type of cam/wheel is located anywhere from ⅜" to ⅝" from the axle hole, depending on the diameter of the eccentric cam. When used in a bow, cam 10 creates an eccentric or offset gyrating kick. This kick can interfere with the user's aim and typically is only partially absorbed by any dampeners and counterweights, with the remaining kick transmitted to and absorbed by the user.

In certain embodiments of the present invention, by arranging, placing or reducing the weight/mass at one or more locations on the cam (FIG. 2), the effective center of mass can be zeroed to the centerline of the axle to reduce or eliminate this gyration or kick. In a preferred embodiment, a "zeroed" cam with a center of mass co-axial with the axle location will spin freely as a concentric wheel does on a central axis. The even distribution of mass around the axle eliminates the traditional kick or gyration upon bowstring release created by an eccentrically located axle hole.

The weight/mass added to a cam can be made from the same material, or made from a material of a higher or lower specific gravity. In an alternate embodiment, mass is removed from portions of the cam profile, either alone or in combination with adding mass to portions of the cam in order to balance the center of mass with the axle location. Optionally, the mass can be integrated into the material of the cam body or can be mounted to the cam as a component.

In further preferred embodiments of the present invention, cams having a center of mass coaxial with the axis can be used with "one cam," "two cam" or "Cam&½®" style bows, where the mass centered cams are located at least at one limb tip 209, and optionally at the tips of both limbs. Each cam is preferably mounted with an axle pin 230 extending between the cam and the limb tip, for example within fork, split or quad limb designs. An axle or axle pin is typically a metal bar or tube extending through the cam body.

A one cam bow (shown in FIG. 3) typically has one eccentric cam at one limb tip, and a circular idler wheel at the opposing limb tip. The idler is typically mounted to the upper limb and the cam mounted to the lower limb; however, this can be reversed if desired. A centrally mounted circular idler wheel, with equal weight distribution, typically will not exhibit a moment or kick around the idler wheel axis. The present invention allows both the idler wheel and opposing cam to rotate without eccentric gyration. One example of a one cam style bow is taught in U.S. Pat. No. 5,368,006, incorporated herein by reference.

A two cam system uses mirror imaged cams that must be kept in perfect time or synchronization in order to function properly. A "Cam&½®" or "one & one half cam" hybrid style system, does not use a circular idler wheel, and instead uses two hybrid cams. Like a two cam system, a Cam&½ style system needs to be timed in order to shoot properly. Unlike a two cam system, a Cam&½ style system uses cams that are not a mirror image of one another. Two "zeroed" or mass centered cams of the present invention can be used in either a two cam or Cam&½ style system to allow both cams to rotate without eccentric gyration.

In some preferred embodiments, mass zeroed cams are used with bows where the bow limbs and riser emphasize vertical limb movement. In these embodiments the limb tips are designed to travel primarily vertically as the bow's bowstring is released. This can be done, for example, by pre-curving the limbs or by changing the limb pocket or connection angle on the riser to a more horizontal angle. The vertical limb movement combined with zeroed cams further substantially reduces the kick and vibration of the bow upon release. This preferably assists a user's aim and provides more efficient energy transfer. This vertical limb movement plus mass zeroed cams can be used on the three types of cam systems now used in the archery industry. Examples of bows with pre-curved limbs are taught in U.S. Pat. Nos. 5,749,351; 5,901,692 and 5,921,227, incorporated herein by reference.

The following illustrations primarily show the center of mass on a "one cam system;" however, use of the present invention is not limited to a one cam system. Adaptation and use with other style systems will be understood by those of skill in the art.

Figure 2:
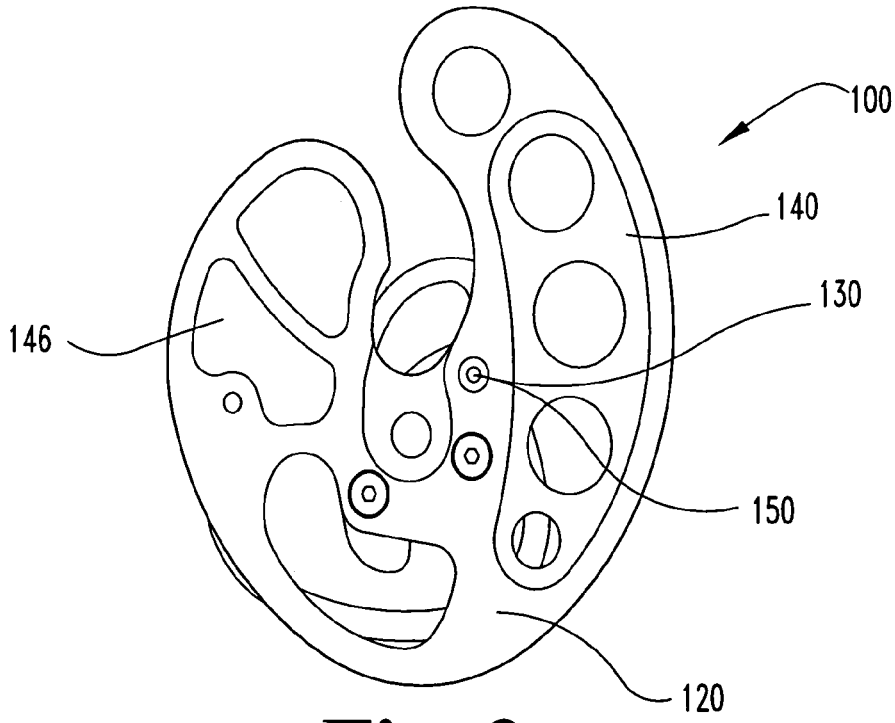
FIG. 2 is a profile of a cam illustrating one preferred embodiment of the present invention.

FIG. 2 shows a "zero center of mass cam" 100 according to a preferred embodiment of the present invention. Cam 100 includes a non-circular cam body 120, with an eccentrically located axle location such as axle hole 130. The axis of the effective center of mass 150 is co-axial in relation to the axle hole 130.

One option for centering the center of mass over the axle hole is by locating one or more weights 140, such as a brass weight, on cam body 120 in one or more proper locations to move the effective center of mass 150. The weight may be a continuous piece or multiple pieces spaced as desired to effectively move and balance the center of mass as desired.

The center of mass location 150 can be separately adjusted by machining lightening holes 146 to remove material in one or more locations on a weight or cam body 120. The lightening holes may extend all or partially through portions of the weight or cam body. Preferably, by balancing the design of the cam body 120, one or more weights 140 and one or more holes 146, the X-Y center of mass 150 can be located at the exact centerline of the axle location 130. This creates a cam which spins with a substantially reduced and minimal kick or gyration. Examples of preferred weighting materials include aluminum, brass, copper, zinc, lead, tungsten, stainless steel, rubber, plastic and polymer based materials.

Figure 3:
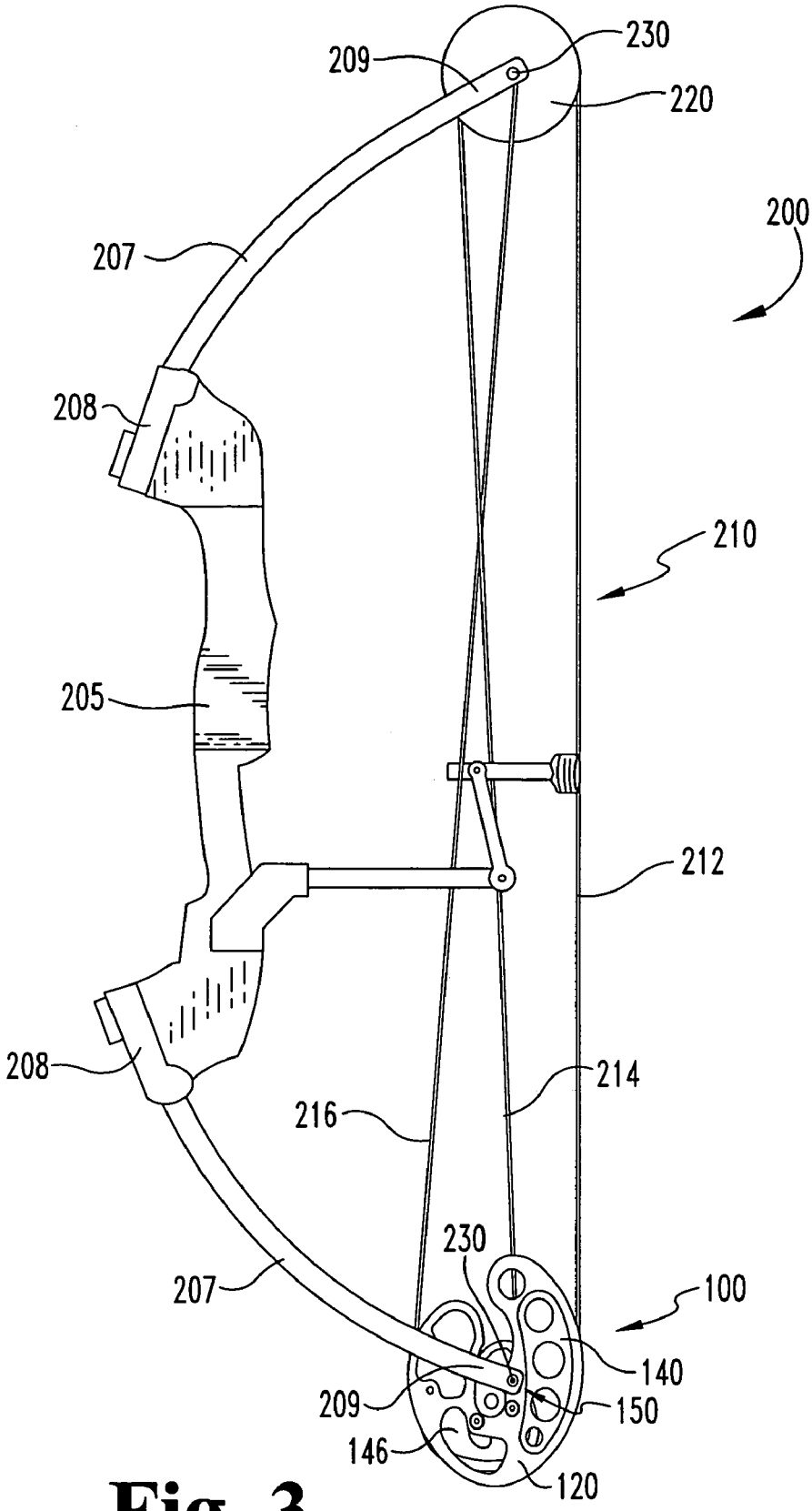
FIG. 3 illustrates a bow according to a preferred embodiment of the present invention.

FIG. 3 shows a one-cam style bow 200 with a cam 100 and a circular idler wheel 220 according to one preferred embodiment of the present invention. In this embodiment, cam 100 includes two feed out tracks for bowstring 212 and cable portion 214, and a take-up track for an anchor cable 216 as the bow 200 is drawn. In this embodiment, the center of mass 150 is coaxial with an axle 230 through limb tip 209.

The weights and lightening holes can be separate or combined with components integral with or mountable on the cam. For example, some cams, such as one cam systems, have two feed-out cable tracks and one anchor cable take-up track. The tracks are defined by independent sub-cam profiles on the cam. The cam profiles may be defined, for example, using continuous grooves or non-continuous grooves such as posts with or without groove portions. Weights or holes to adjust the center of mass can be separate or combined with these cam profiles.

Figure 4B:
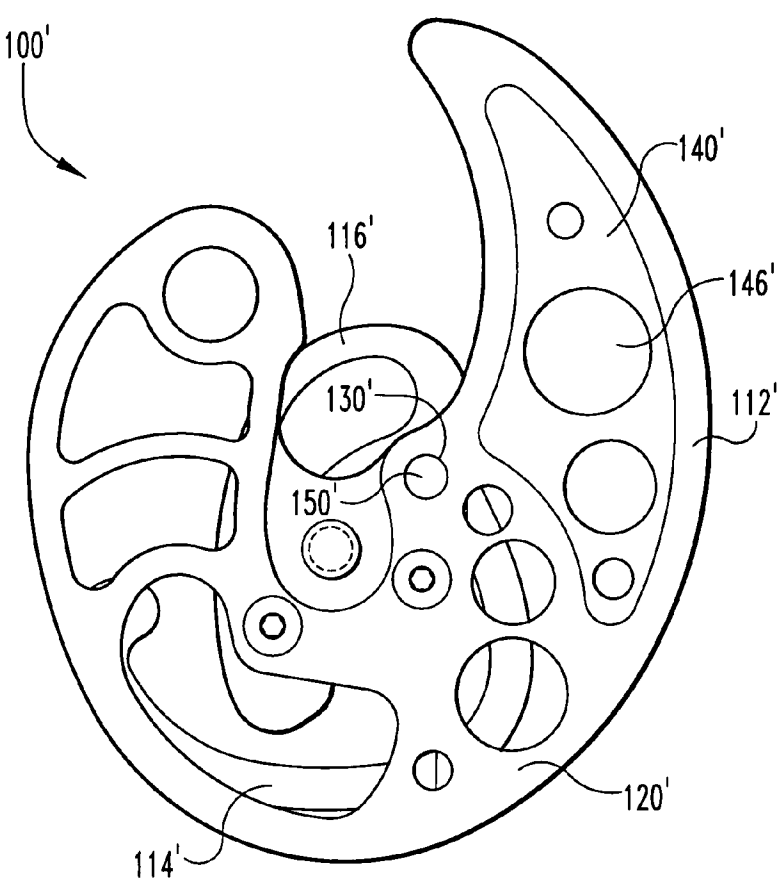
FIGS. 4A and 4B are profiles of a cam illustrating an alternate preferred embodiment of the present invention.
Figure 4A:
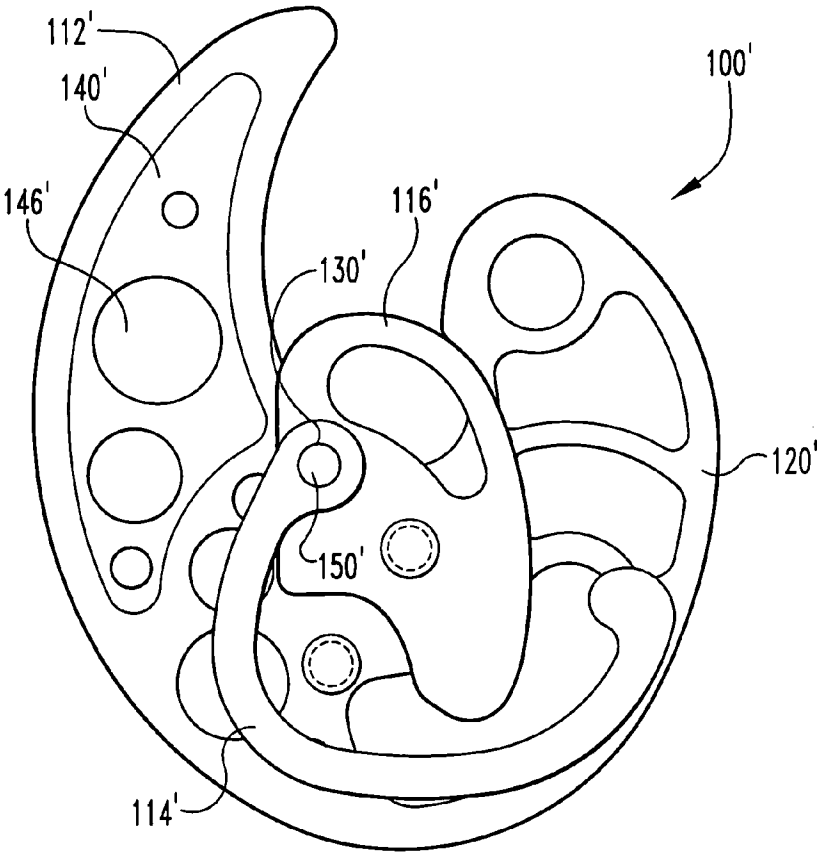
Figure 5A:
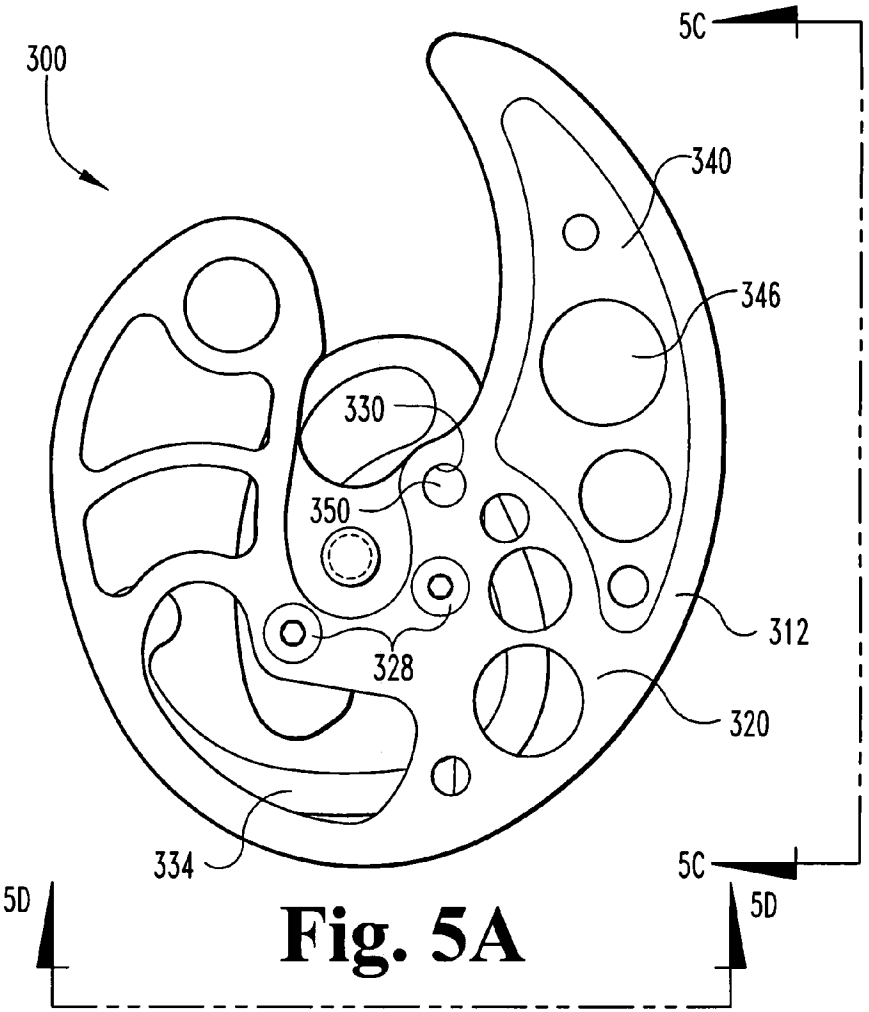
FIGS. 5A-D are profiles of a cam illustrating a further preferred embodiment of the present invention.
Figure 5B:
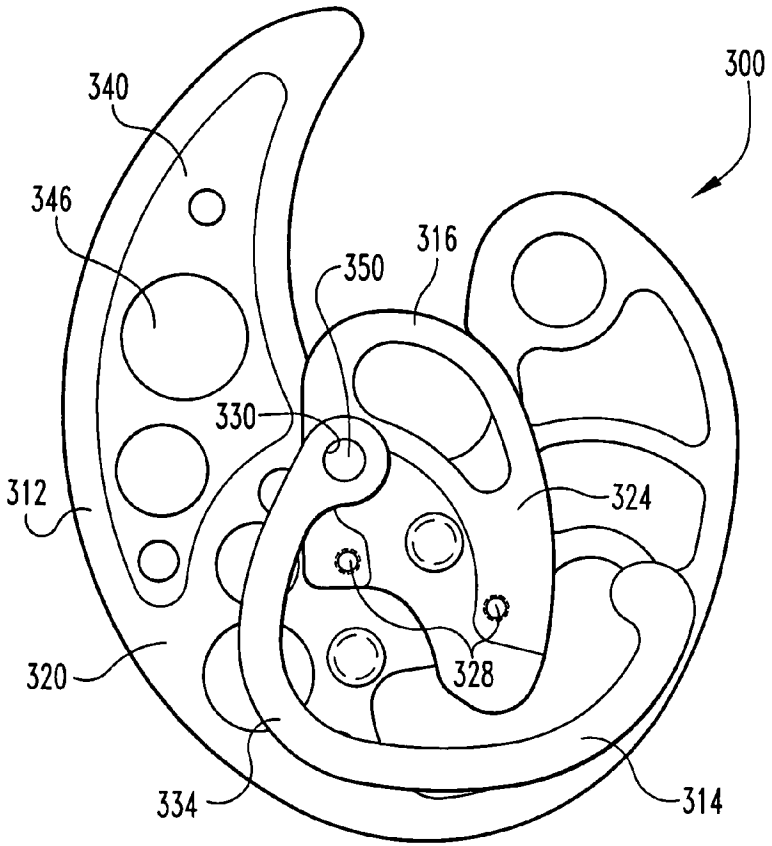
Figure 5C:
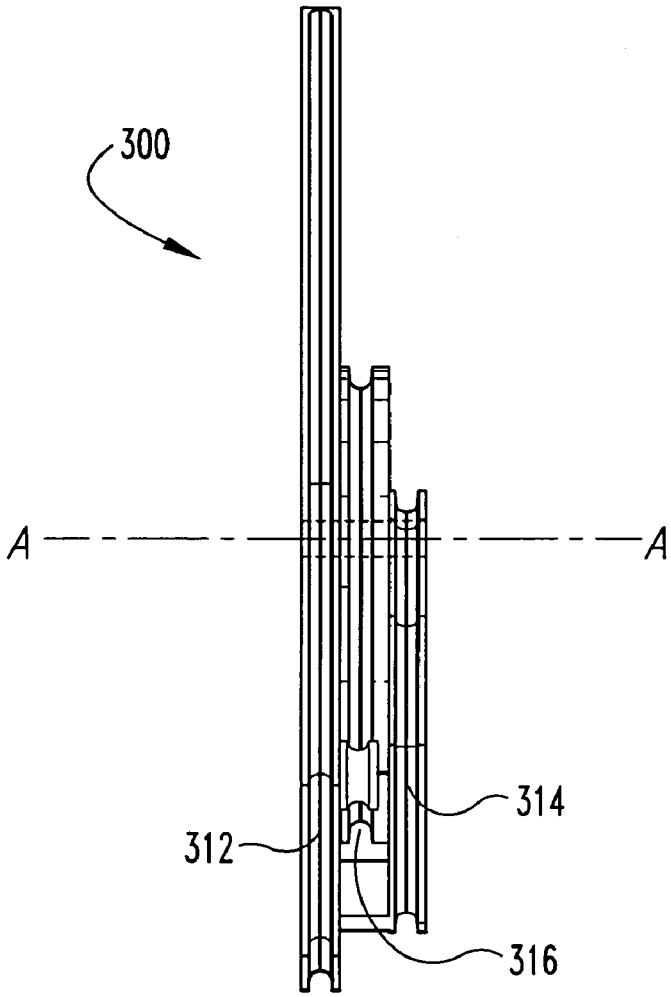
Figure 5D:
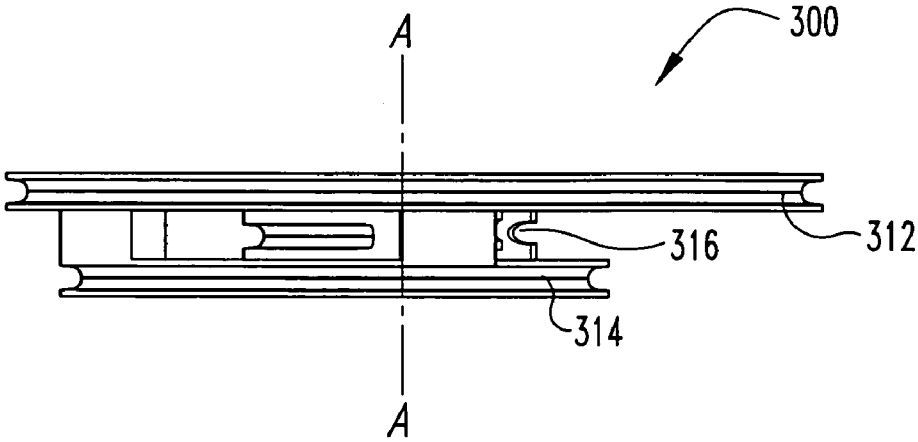

FIGS. 4A and 4B show side views of an alternate embodiment of a "zero center of mass cam" 100' according to a preferred embodiment of the present invention. Cam 100' includes a non-circular cam body 120', with an eccentrically located axle location such as axle hole 130'. The axis of the effective center of mass 150' is co-axial in relation to the axle hole 130'. A weight 140' is mounted to cam body 120'. Lightening holes 146' are defined in cam body 120' and weight 140'. Cam body 120' defines a bowstring cam 112', a return cable cam 114' and an anchor cable cam 116'. In this embodiment, cam body 120' is machined from one piece of material, such as 6061T6 aluminum.

FIGS. 5A-D show views of a further embodiment of a "zero center of mass cam" 300 according to a preferred embodiment of the present invention. Cam 300 includes a non-circular cam body 320, with an eccentrically located axle location such as axle hole 330. A weight 340 is mounted to cam body 320. One or more lightening holes 346 are defined in cam body 320 and weight 340. Cam body 320 preferably defines a bowstring cam 312, a return cable cam 314 and an anchor cable cam 316. The effective center of mass axis 350 is co-axial in relation to the central axis A-A of axle hole 330.

In certain embodiments, modules such as module 324 are mounted to cam body 320 to partially define one of the cams or tracks, for example anchor cable cam 316. Module 324 is mounted to cam body 320 with two screws 328. In a preferred embodiment, a module is selected from various modules, such as shown in FIGS. 9A-E, and each module can be substituted on the cam body to change the profile of the anchor cable cam and the bow's effective draw length.

Figure 6:
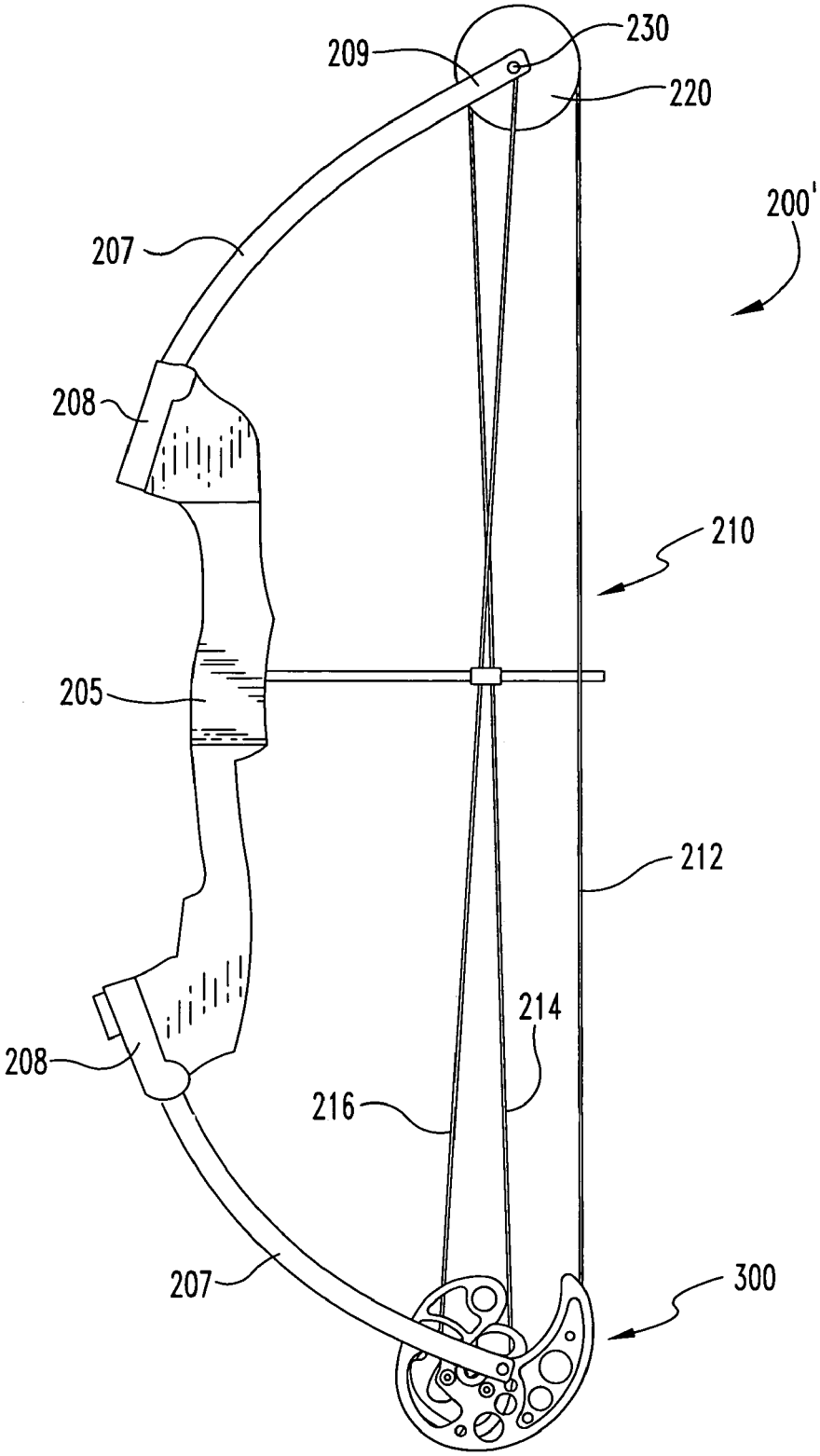
FIG. 6 illustrates a bow according to a preferred embodiment of the present invention with the cam of FIGS. 5A-D.
Figure 7A:
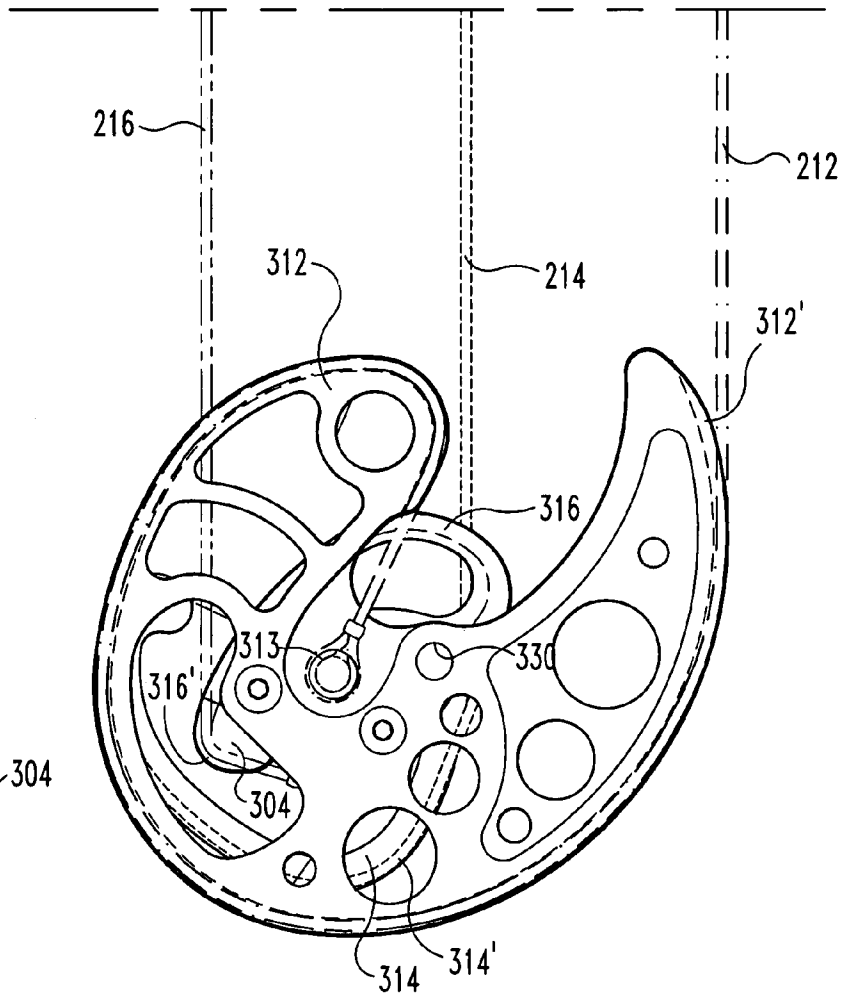
FIGS. 7A and 7B are profiles of the cam and cable system used in FIG. 6.
Figure 7B:
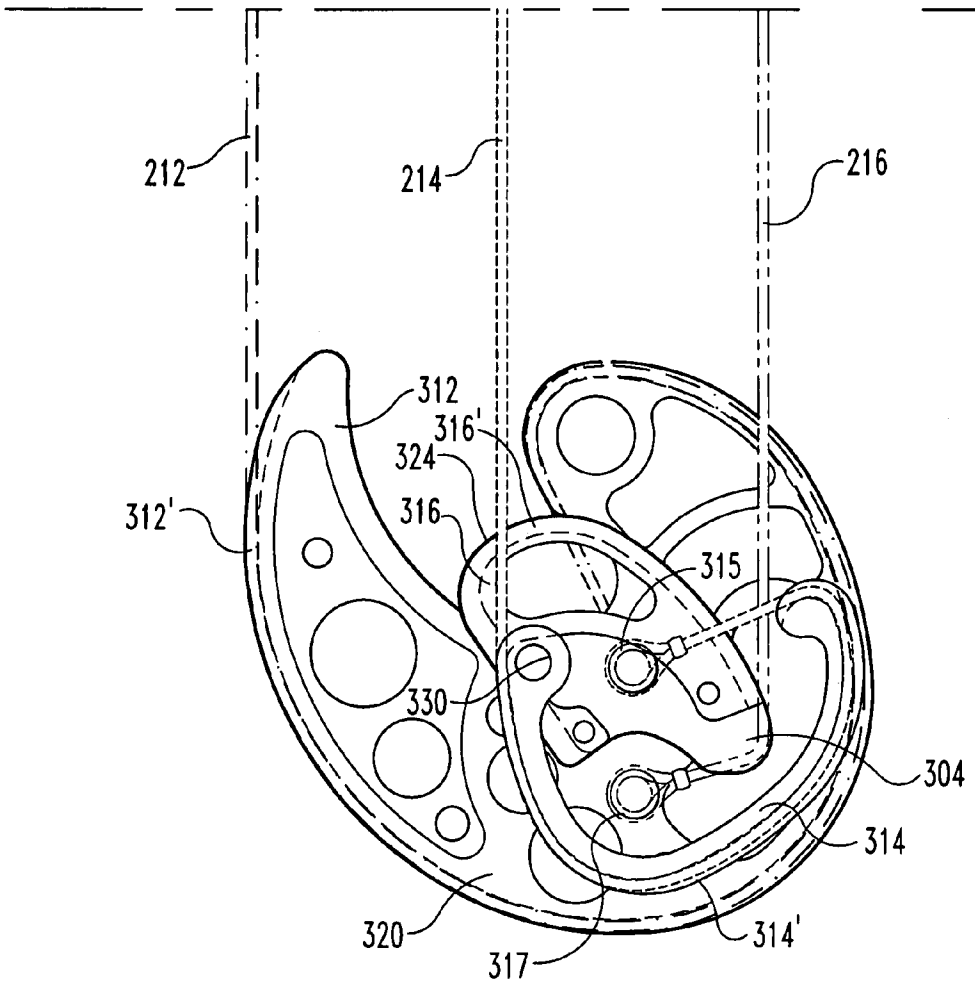

FIG. 6 shows a one-cam style bow 200 with a circular idler wheel 220 and cam 300. Cable system 210 with respect to cam 300 is illustrated in detail in FIGS. 7A and 7B. As illustrated, bowstring portion 212 is received in a bowstring path 312' defined by bowstring cam 312. An end of bowstring 212 is anchored to an anchor peg 313. Return cable 214 is received in a return cable path 314' defined by return cam 314. One end of return cable 214 is anchored to an anchor peg 315. Anchor cable 216 is received in a anchor cable path 316' defined by an anchor cam 316. One end of anchor cable 216 is anchored to an anchor peg 317. The anchor pegs may be fixed, or in some embodiments are adjustable in position. In a preferred embodiment, the bowstring cam, return cam and anchor cam are each journaled around the axle location.

In a one-cam style system, bowstring 212 and return cable 214 are portions of one cable with an intermediate portion received around an idler wheel on the distal limb. Anchor cable 216 may extend from cam 300, to the opposing limb tip, and may be anchored to the limb tip, for example with a split-Y yoke mounted to the idler wheel axle. In a brace or undrawn configuration, bowstring 212 defines a substantially straight or vertical line between and with respect to the outer or rearward edges of the cam and idler wheel.

Figure 8:
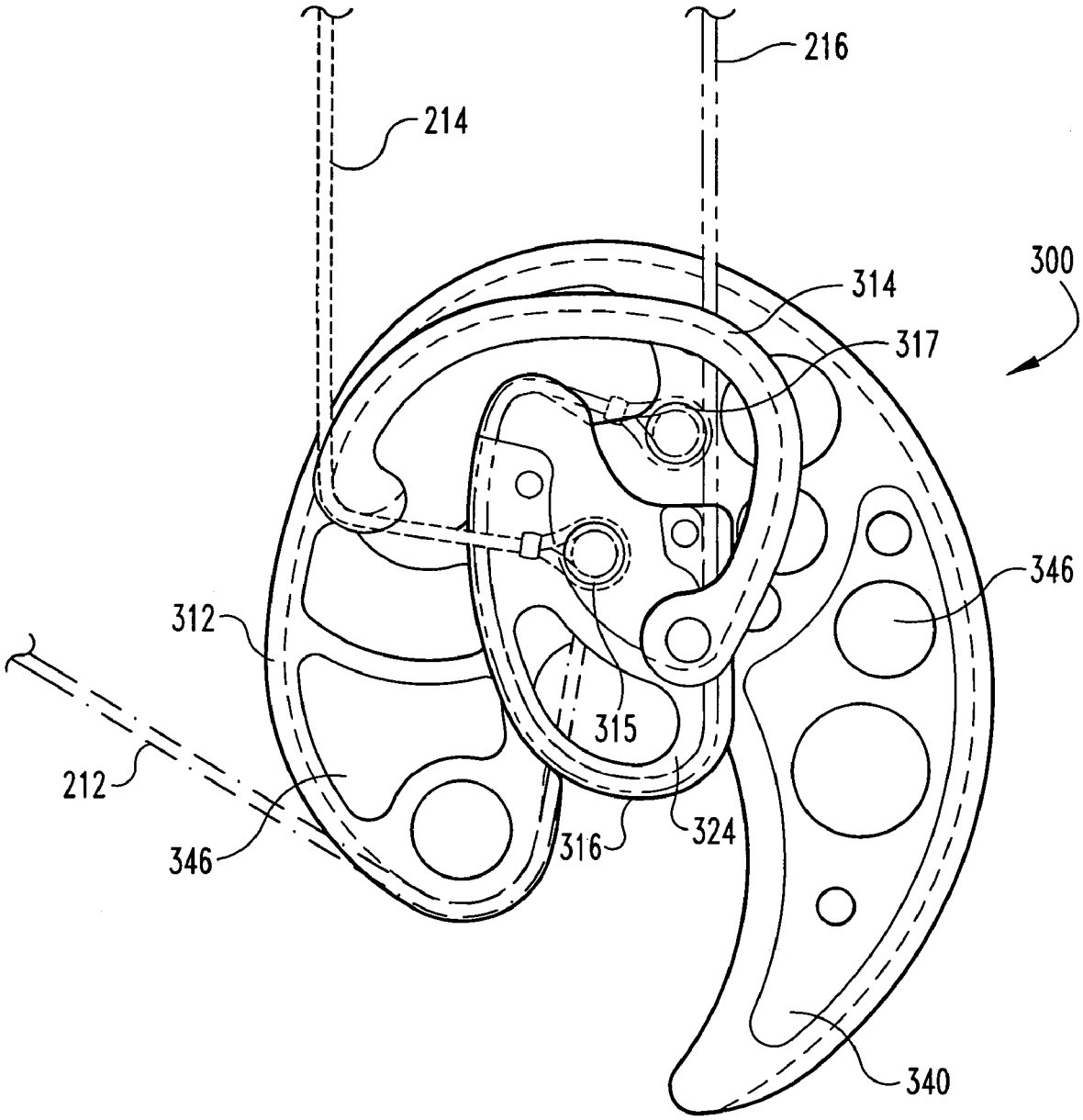
FIG. 8 is a profile of the cam and cable system of FIGS. 7A and 7B in a drawn position.
Figure 9A:
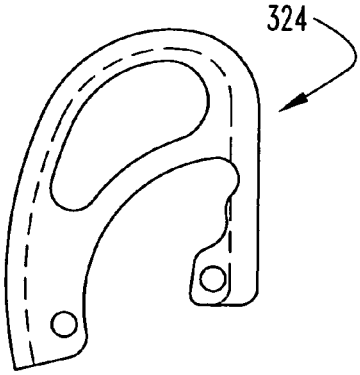
FIGS. 9A-E illustrate embodiments of cam modules usable with the cam of FIGS. 5A-D.

Cam 300 and portions of cable system 210 are illustrated in FIG. 8 in detail with the bow in the drawn configuration. When bowstring 212 is drawn, cam 300 on the lower bow limb rotates, in a clockwise direction from the perspective of FIG. 7B to FIG. 8. Bowstring 212 is let-off from bowstring cam 312 and extends rearwardly at an increasing angle as the bow is drawn. Return cable 214 is let-off from return cam 314 towards idler wheel 220. Anchor cable 216 is taken up by anchor cam 316. The configuration of anchor cam 316 preferably defines a stop mechanism or bumper for the anchor cable, inhibiting further rotation and indicating that the bow has reached a fully drawn position. In the fully drawn position, anchor cable 216 is preferably substantially straight and vertical between the cam 300 and the opposing limb tip mounting point, such as axle 230. Typically, the anchor cam stop position stops the anchor cable in a vertical position substantially adjacent the cam axle. The overall cam rotation is approximately 180 degrees.

Some bows allow interchangeable modules to be mounted on one or two cams to change the bow draw length. In a still further embodiment, a cam can be matched with one module or a set of different profile modules designed to zero the center of mass when the cam is used with any one of the modules. FIGS. 9A-E illustrate one set of such modules, including modules 324, 324', 324", 324''' and 324''''. Each module is preferably designed to be mounted on cam body 320 to form a portion of anchor cam 316, with each module assisting to define a different geometry anchor cable path 316'. The modules each have a defined mass and solid portions plus weights and/or lightening holes.

Various fasteners can be used to attach a module to the cam body. Typically a module is mounted to cam body 320 using two module fasteners, such as flat head cap screws 328 as illustrated in FIG. 10B. Preferably the module fasteners extend at least partially through the module and the cam body. Preferably at least one fastener is used and two or more is preferred.

Preferably each module is designed and arranged with a geometry and mass such that any one of the modules can be mounted on cam body 320 with the result that the center of mass 350 of cam 300 is maintained as coaxial with the axis of axle 330. Additional mass or lightening holes can be added or defined in each module to obtain the desired configuration. The overall balancing arrangement of the module and cam also factors in the mass, location and specific gravity of the module fasteners and fastener holes.

Figure 10A:
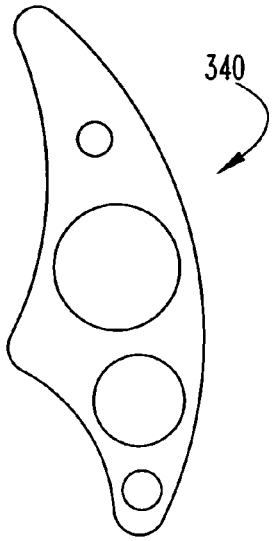
FIG. 10A illustrates a weight usable in certain preferred embodiments of the present invention.
Figure 10B:
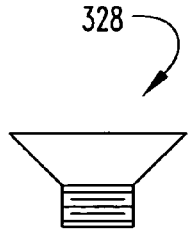
FIG. 10B illustrates a module mounting screw usable in certain preferred embodiments of the present invention.
Figure 9B:
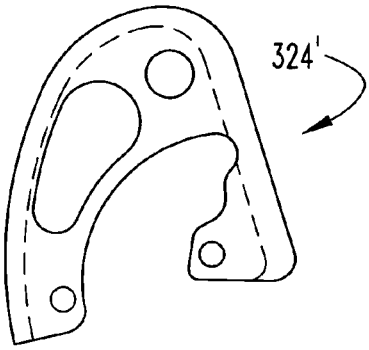
Figure 9C:
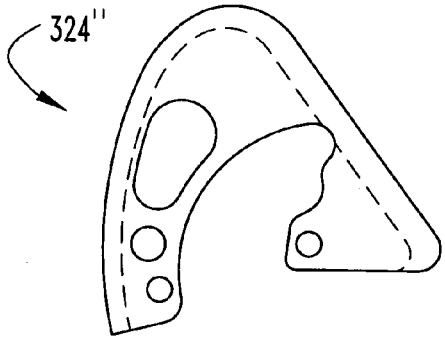
Figure 9D:
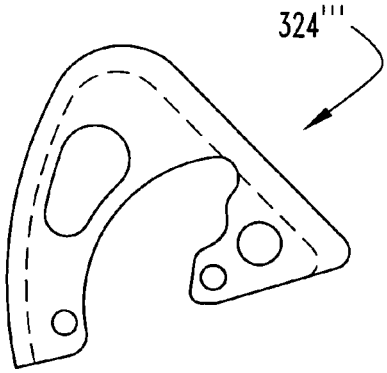
Figure 9E:
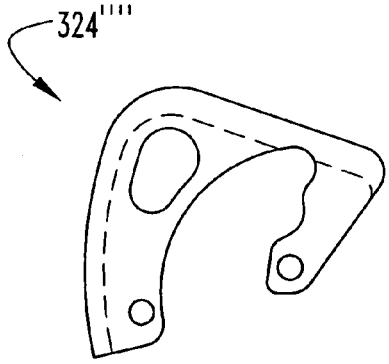

An example profile of a weight 340 is illustrated in FIG. 10A. An example profile of a module screw 328 is shown in FIG. 10B. Preferably the materials used for the cam, cam module, weight and any fasteners are chosen for their strength and specific gravity and considered in the overall analysis to balance or zero the cam. For illustration purposes, as an example only, the cam body 320 and cam module 324 or modules are formed from an aluminum material or alloy with a specific gravity of 0.097 lbs/in$^3$. In this example, weight 340 is formed from a brass alloy with a specific gravity of 0.305 lbs/in$^3$, and the module screws are formed from a steel alloy with a specific gravity of 0.25 lbs/in$^3$.

Figure 11B:
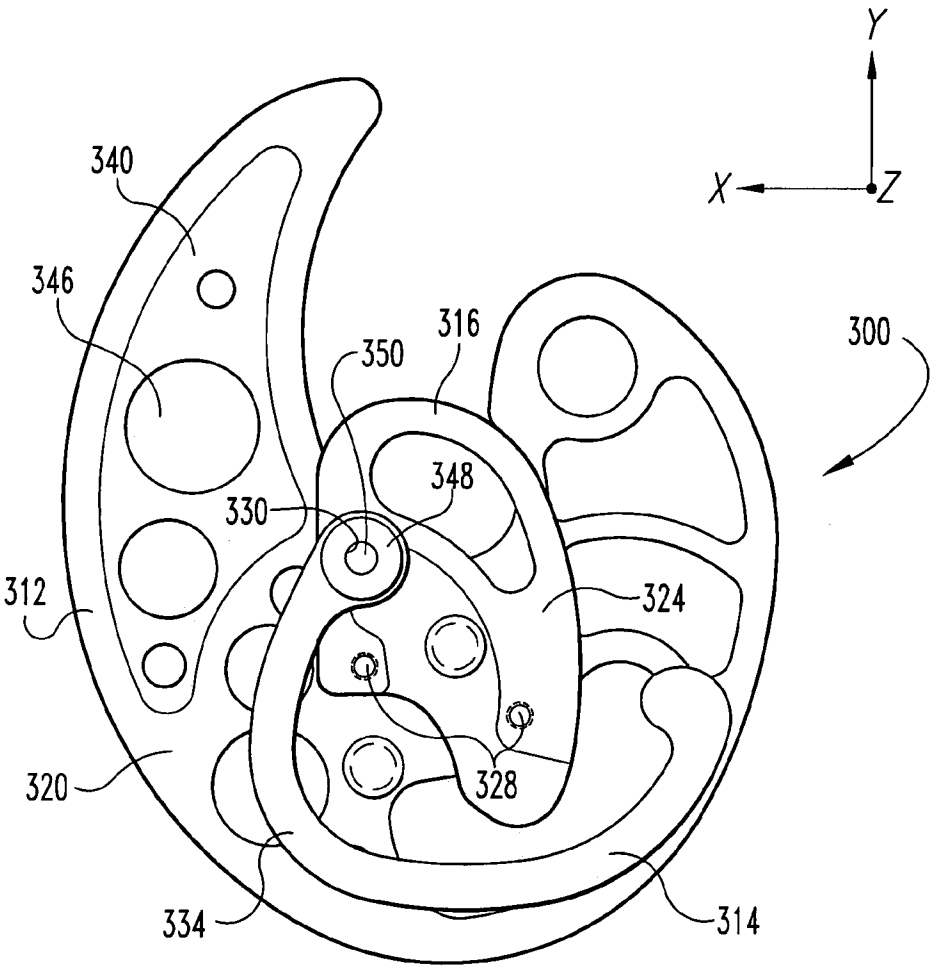
FIG. 11B is an X-Y profile of the cam of FIG. 11A.
Figure 11A:
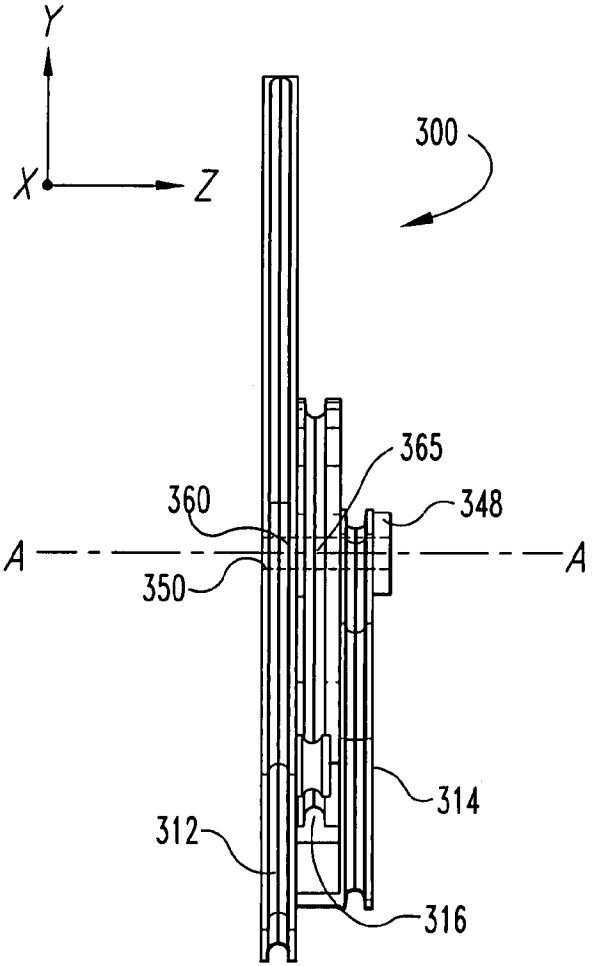
FIG. 11A is an X-Z profile of a cam illustrating an alternate preferred embodiment of the present invention.

FIGS. 11A and 11B illustrate a version of "zero center of mass cam" 300. Cam 300 is balanced in at least two and preferably three dimensions with regard to the center of mass in the X-Y, Y-Z and X-Z planes. Cam 300 includes a non-circular cam body 320, with an eccentrically located axle location such as axle hole 330. As discussed above, the axis of the X-Y effective center of mass 350 is preferably co-axial in relation to the axle hole 330. One option for centering the X-Y center of mass over the axle hole is by locating one or more weights 340, such as a brass weight, and lightening holes 346 arranged with mass or openings in one or more proper locations to move the effective X-Y center of mass 350.

As an additional option, the Y-Z center of mass 360 of cam 300 is preferably centrally balanced in a Y-Z orientation on cam body 320. The cam profiles may be formed with portions having different sizes and corresponding masses, as shown most clearly in FIG. 11A, tending to offset the effective Y-Z center of mass 360 from the Y-Z center 365 of cam 300. For clarity, FIG. 11A illustrates the Y-Z center of mass 360 before balancing, shown as slightly offset in the Z-direction with respect to the center or midpoint 365 of passageway 330 for the cam axle.

As a preferred feature, preferably the Y-Z center of mass 360 is balanced or "zeroed" to align the Y-Z center of mass 360 with the center 365 of cam 300. This reduces and preferably eliminates any side-to-side wobble or kick of the cam as the bowstring is released and the cam rotates around its axle. The Y-Z center of mass 360 can be moved to one side or the other by adding mass and weight of the same or a different material at one or more points and/or by creating holes or voids to lighten one or more of the cam profiles. Preferably the center or midpoint 365 of the passageway and axle also corresponds to the centerpoint of the corresponding limb tip when the cam is mounted.

One example of adding mass is by adding an annular element, such as a washer 348 mounted to one side of cam 300. Preferably any added or removed mass for Y-Z balancing is aligned with the axle location 330 or distributed around the axle location with the X-Y center of mass of the added or removed weight or hole aligned with the axle location to maintain the cam's X-Y balanced center of mass. Similarly, mass or lightening holes can be arranged and added or removed to balance the cam in the X-Z perspective while maintaining the cam's X-Y center of mass. In one preferred embodiment, the cam is balanced in the X-Y, the X-Z and the Y-Z dimensions.

Cams having Y-Z and X-Z balanced centers of mass can be used with "one cam," "two cam" or "Cam&½®" style bows, where the mass centered cams are located at least at one limb tip, and optionally at the tips of both limbs. Preferably the cams are optimized to be balanced in the X-Y, Y-Z and X-Z planes to minimize wobble or kick in three dimensions.

In some alternate preferred embodiments, mass zeroed cams are used with bows where the bow limbs and riser emphasize vertical limb movement. In these embodiments the limb tips are designed to travel primarily vertically as the bow's bowstring is released. In certain examples, the bow limbs are mounted with the distal limb ends tangent with a line at an interior angle from a vertical axis line defined by the riser. The interior angle is preferably in a pre-drawn range of approximately 70-90° and preferably is at least 75°.

Figure 12:
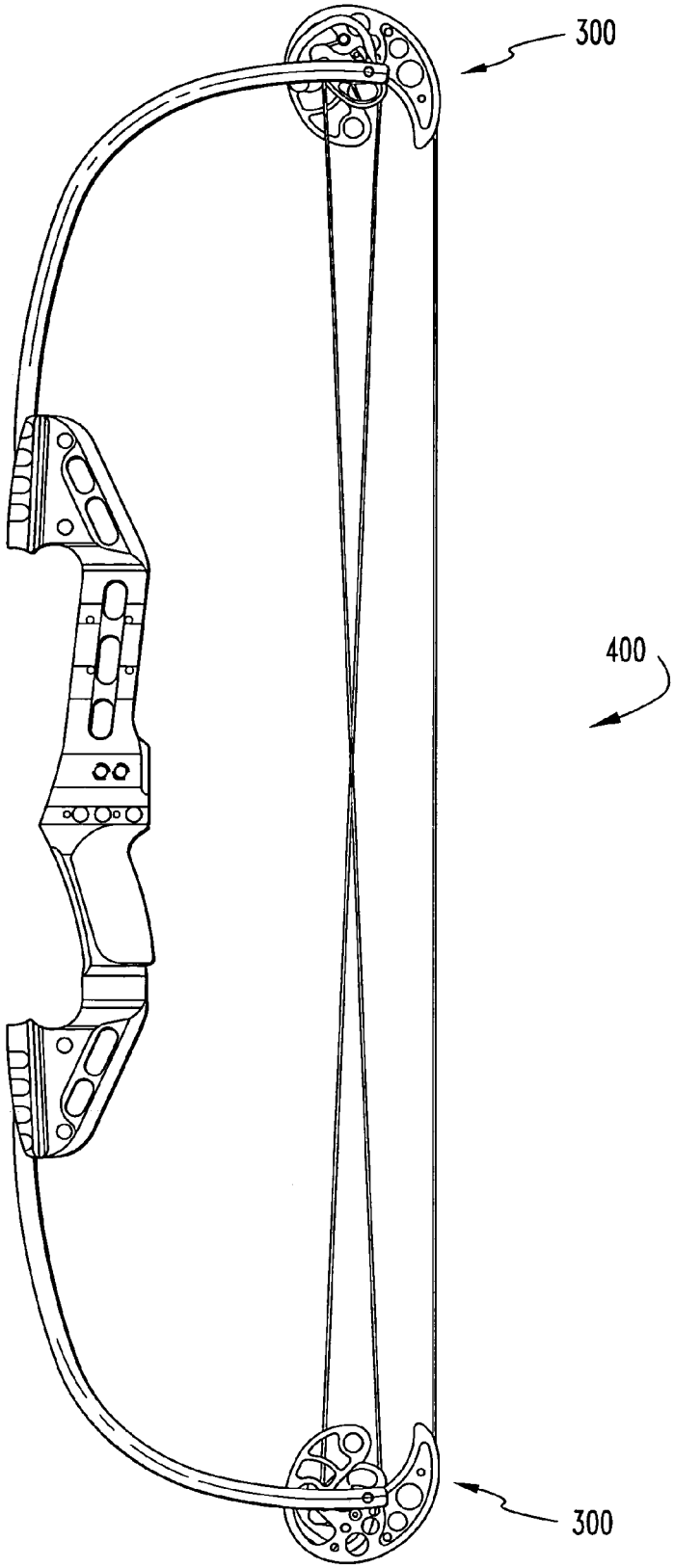
FIG. 12 illustrates a bow according to an alternate preferred embodiment of the present invention.

A vertical style bow 400 with pre-curved limbs emphasizing vertical movement of the limb tips is illustrated in FIG. 12. Bow 400 is illustrated in a two-cam style configuration, with mirror image eccentric cams mounted at the upper limb tip and the lower limb tip.

Figure 13:
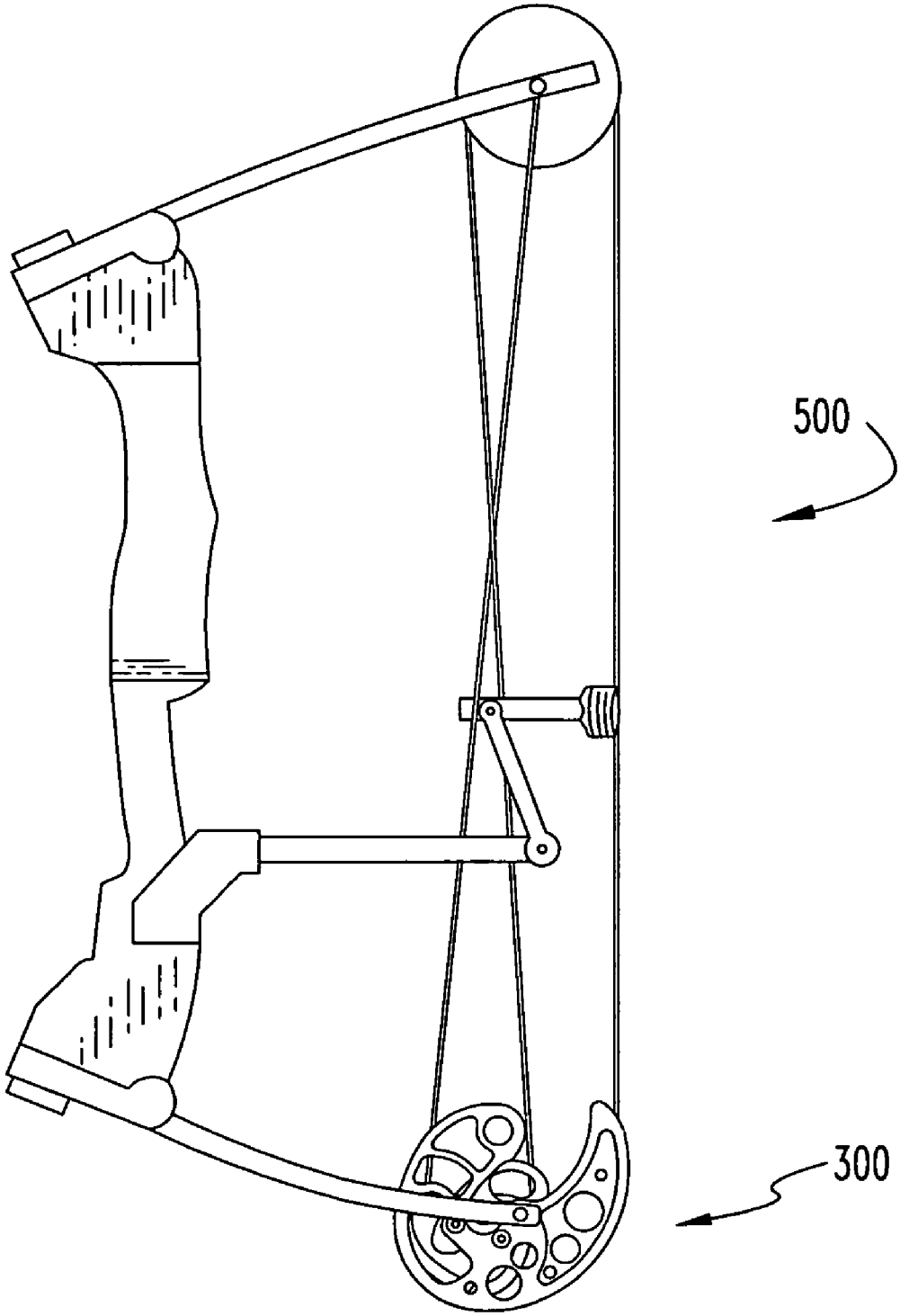
FIG. 13 illustrates a bow according to a further preferred embodiment of the present invention.

A bow 500 with more horizontally arranged limbs and angled limb pockets is illustrated in FIG. 13. In bow 500, angled limb pockets preferably form an angle from the vertical axis of the riser. Preferably the pocket angle is greater than 15° and preferably is greater than approximately 45°. Typically, the pocket angle and limb curve combine for a total interior angle of approximately 70°-90° and preferably at least 75°. This limb arrangement is sometimes referred to as parallel limbs. Bow 500 is shown with cam 300 mounted on the lower limb tip. A parallel limb style bow typically has a shorter bowstring length and draw than a bow with more vertically angled limbs.

The vertical limb movement combined with zeroed cams further substantially reduces the kick and vibration of the bow upon release. This preferably assists a user's aim and provides more efficient energy transfer. This vertical limb movement plus mass zeroed cams can be used on the three types of cam systems now used in the archery industry.

EXAMPLE

Figure 14:
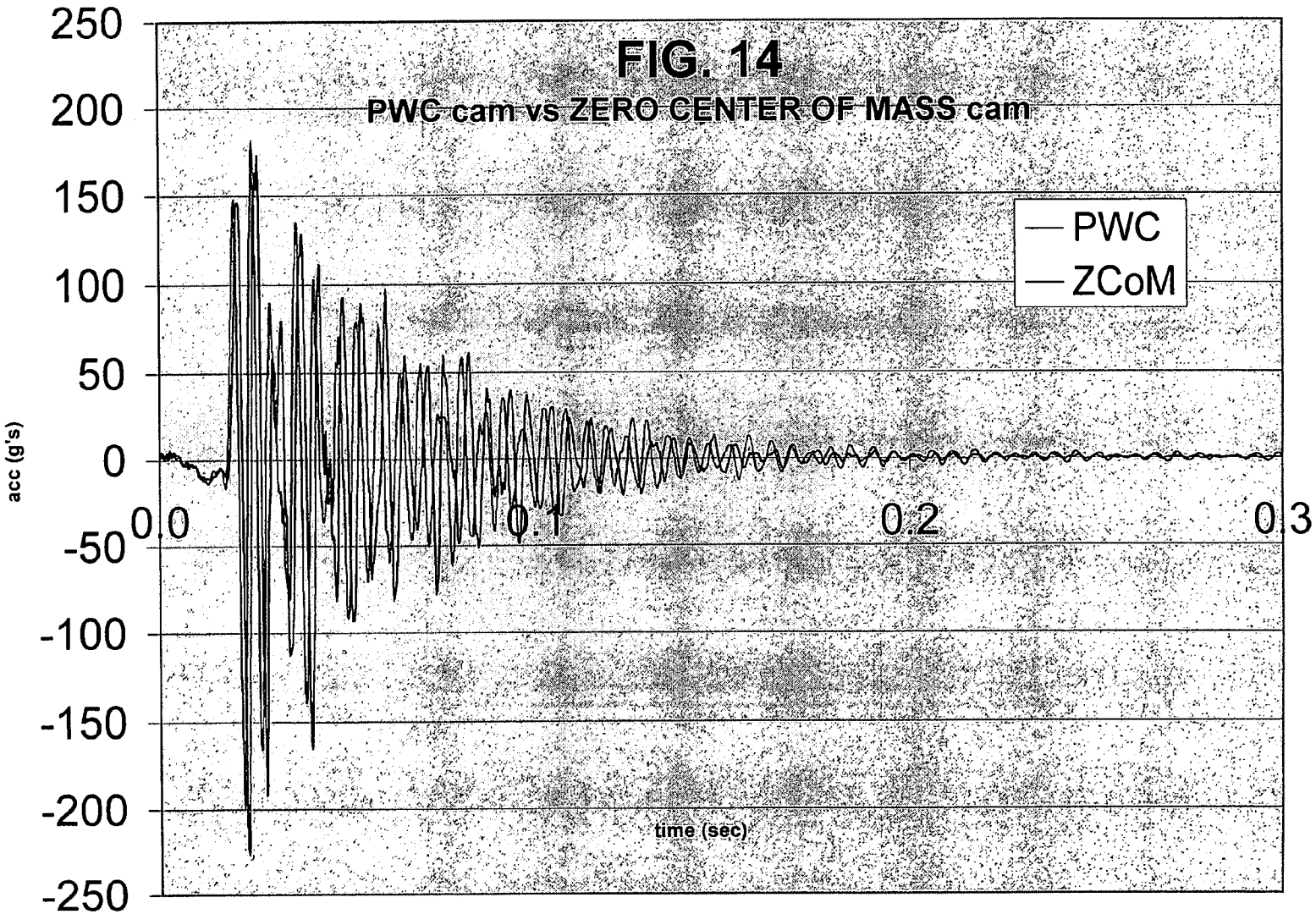
FIG. 14 is a graph illustrating test data from a prior art bow and a bow according to a preferred embodiment of the present invention.

To test and illustrate the kick or vibration/shock reduction of an embodiment of the present invention, a bow mounted with a cam according to the present invention was tested against a bow mounted with a perimeter weighted cam (PWC). The test bow used was a Jennings model CK3.5 bow equipped with a perimeter weighted cam and then equipped with a "zero center of mass" cam according to a preferred embodiment of the present invention. The test data is shown in graphical form in FIG. 14.

The specifications for the Jennings model CK3.5 bow with a perimeter weighted cam were as follows:

| | Test Results |
|---|---|
| Friction (ft-lbs) | 6.86 |
| Fwd Curve (ft-lbs) | 75.99 |
| Rev curve (ft-lbs) | 69.13 |
| % Let-Off (effective) | 83.47 |
| Mn Force (lbs) | 11.00 |
| True Draw (in) | 27.11 |
| A-A (in) | 35.25 |
| Brace (in) | 8.20 |
| Power Stoke (in) | 18.91 |
| Peak Stroke (lbs) | 66.59 |

-continued

| | Test Results |
|---|---|
| AMO DrawLength (in) | 28.86 |
| Holding Wt (lbs) | 11.00 |

The specifications for the Jennings model CK3.5 bow with a zero center of mass cam were as follows:

| | Test Results |
|---|---|
| Friction (ft-lbs) | 5.77 |
| Fwd Curve (ft-lbs) | 77.01 |
| Rev curve (ft-lbs) | 71.24 |
| % Let-Off (effective) | 73.97 |
| Mn Force (lbs) | 17.14 |
| True Draw(in) | 21.12 |
| A-A (in) | 35.00 |
| Brace (in) | 8.45 |
| Power Stroke (in) | 18.57 |
| Peak force (lbs) | 65.84 |
| AMO DrawLength (in) | 28.87 |
| Holding Wt (lbs) | 17.14 |

Data for each bow configuration was collected over ten tests. The arrow used for all tests weighed 398.8 grains An accelerometer from PCB was mounted at the bow handle portion to simulate an archer's grip points, and was used (#352A10 SN 24060) in conjunction with National Instruments software "VirtualBench" version 2.6 to collect data indicating the gravities (g) applied to the bow upon release of the bow. The root mean square "RMS" method was used to process the data. The RMS method is frequently used in statistics to calculate magnitudes with respect to a varying function. The RMS method allows a calculation of the overall magnitude, in this case vibration or shock, delivered to the system.

In the present measurements, the accelerometer had a sensitivity of 10.30 mV/g as provided in the manufacturer's calibration card. Data was measured in increments of 0.000391 seconds. Raw data was measured and used for a time period from 0 seconds to 0.4 seconds, after which time the system vibration has diminished to substantially equilibrium. The raw data, measured in volts, was divided by 0.0103 to convert to gravities "g's" as "modified data." Under the RMS method, the modified data was squared and the mean was calculated. The square root of the mean was taken to result in a RMS vibration/shock value. The ratio of the PWC RMS value to the zero center of mass cam RMS value provides the percentage reduction in vibration/shock between the tests.

The data results were as follows:

| Test | Mean g's$^2$ | Square root (RMS) (g's) |
|---|---|---|
| | CK3.5 PWC | |
| 35-1 | 957.5582 | 30.94444 |
| 35-2 | 998.0024 | 31.59118 |
| 35-3 | 949.0807 | 30.80715 |
| 35-4 | 1030.352 | 32.0991 |
| 35-5 | 1068.251 | 32.68411 |
| 35-6 | 1072.245 | 32.74515 |
| 35-7 | 1028.961 | 32.07743 |

-continued

| Test | Mean g's$^2$ | Square root (RMS) (g's) |
|---|---|---|
| 35-8 | 1009.942 | 31.77958 |
| 35-9 | 1026.007 | 32.03134 |
| 35-10 | 1025.65 | 32.02577 |
| | CK3.5 Zero Center Of Mass Cam | |
| 35-1 | 780.9944 | 27.94628 |
| 35-2 | 880.0692 | 29.66596 |
| 35-3 | 870.8732 | 29.51056 |
| 35-4 | 894.4499 | 29.90736 |
| 35-5 | 865.0753 | 29.41216 |
| 35-6 | 896.1159 | 29.93519 |
| 35-7 | 918.9028 | 30.31341 |
| 35-8 | 870.4562 | 29.50349 |
| 35-9 | 904.9971 | 30.08317 |
| 35-10 | 882.9703 | 29.71482 |

The mean RMS for the CK3.5 with the PWC was 31.8785 g's. The mean RMS for the CK3.5 with the zero center of mass cam was 29.5992 g's. This illustrates a 7.15% mean drop in the magnitude of the vibration or kick transmitted to the bow equipped with the zero center of mass cam in comparison to the bow equipped with the perimeter weighted cam.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cam for an archery bow, comprising:

a. a rotatable cam body for an archery bow, wherein said cam body defines a profile;

b. an axle location defined through said cam body such that said cam body profile is eccentrically rotatable around said axle location;

c. wherein the center of mass of said cam body is substantially coaxial with said axle location.

2. The cam of claim 1, wherein said cam body profile is non-circular.

3. The cam of claim 1, comprising at least one weight mounted to said cam body, wherein said weight is formed of a material different than the material of said cam body.

4. The cam of claim 1, wherein the three-dimensional center of mass of said cam is located at the midpoint of said axle location through said cam.

5. A cam for an archery bow, comprising:

a. a rotatable cam body for an archery bow defining at least one cable path;

b. an axle location defined through said cam body such that said cable path is eccentrically arranged around said axle location; and, c. wherein the center of mass of said cam body is substantially coaxial with said axle location.

6. The cam of claim 5, wherein said cam body defines at least a bowstring cable path, a return cable path and an anchor cable path and wherein at least two of said cable paths are eccentrically arranged around said axle location.

7. A cam for an archery bow, comprising:

a. a rotatable cam for an archery bow;

b. an axle location defined through said cam;

c. wherein the mass of said cam body is geometrically irregularly arranged around said axle location; and, d. wherein the mean position of the weighted mass of said cam is substantially coaxial with said axle location.

8. The cam of claim 7, wherein said cam is formed from one piece of material.

9. The cam of claim 7, wherein said cam comprises at least one module mounted on said cam to partially define at least one cable path on said cam.

10. The cam of claim 9, comprising a set of at least two modules mountable on the body of said cam to define different length cable paths, wherein said cam has a center of mass aligned coaxially with said axle when any one of said modules is mounted on said body.

11. The cam of claim 7, wherein said cam comprises a body and at least one weight mounted on said body, wherein said weight is formed of a material different than the material of said body.

12. The cam of claim 11, wherein said weight is formed of a material with a higher specific gravity than the material of said body.

13. A compound archery bow comprising first and second bow limbs attached to a handle, said bow limbs having axle pins therein and wherein an eccentrically rotatably mounted cam defining a bowstring section cam and a return section cam is mounted on one of said axle pins with said axle pin passing through at least said return section cam, a cable having a bowstring section engaged to said bowstring section cam and a return section engaged to said return section cam, whereby rotation of the eccentrically rotatably mounted cam by the bowstring section causes the bowstring section to be let off, whereby during at least a portion of said cam rotation the return section is let off and wherein said eccentrically rotatably mounted cam has a center of mass axis coaxial with the axle pin passing through said cam.

14. A dual-feed single-cam compound bow, comprising, a pair of flexible resilient bow limbs forming first and second distal bow limb ends with a riser connecting proximal bow limb ends thereof;

a drop-off cam journaled on an axle pin at the first distal bow limb end and having eccentric peripheral groove portions wherein each groove portion is journaled on said axle pin;

wherein said cam has a side profile with a center of mass axis coaxial with said axle pin;

a pulley concentrically journaled at the second distal bow limb end and having a peripheral groove;

an elongated cable having an intermediate portion trained around the concentric pulley to form two cable sections extending between the pulley and the cam, one section forming a bowstring having feed-out end portions at both ends thereof and the other section forming a take-up portion at the pulley end thereof and a feed-out portion at the cam end thereof, both received in eccentric groove portions peripheral to the cam in a manner to provide a pair of feed-out sections extending from the cam toward the pulley; and an anchor cable extending between the two limbs with one end thereof fixed to the second bow limb end and the other anchor cable end fixed to the cam and trained in a take-up groove portion of the cam to produce controlled flexing of the bow limbs during the drawing of the bowstring.

15. An archery bow, comprising:

an archery bow riser;

at least one bow limb having a proximal end and a distal end, with said proximal end secured to said riser;

an axle mounted adjacent the distal end of said bow limb;

a cam rotatably mounted on said axle on said bow limb;

a bowstring configured to be eccentrically fed outward from said cam when the archery bow is drawn; and, wherein said cam has a center of mass aligned with said axle.

16. The archery bow of claim 15, wherein said cam is eccentricly rotatably mounted on said axle.

17. The archery bow of claim 16, wherein said bow has a pair of bow limbs each having a distal limb end.

18. The archery bow of claim 17, wherein said bow limbs are mounted with said distal limb ends on a tangent line at an interior angle of at least 75° from a vertical axis defined by said riser.

19. The archery bow of claim 18, wherein said bow limbs are pre-curved.

20. The archery bow of claim 18, wherein said bow limbs are mounted in pockets on said riser, wherein said pockets are mounted at an angle greater than approximately 15° to the vertical axis of said risers.

21. The archery bow of claim 20, wherein said pockets are mounted at an angle greater than approximately 45°

22. A cam for an archery bow, comprising:

a. a cam body for an archery bow, said cam body having a thickness and defining at least one cable path with said path defining a cam plane;

b. an axle passage defined through said cam body perpendicular to said cam plane, wherein said at least one cable path is eccentric to said axle passage;

c. wherein said cam body has a geometrically unequal distribution of mass through the thickness of said cam body with respect to said axle passage; and, d. wherein the center of mass of said cam body along the axis of said axle passage is located substantially at the midpoint of said axle passage.

23. The cam of claim 22, wherein the center of mass axis of said cam body with respect to the cam plane is substantially coaxial with said axle passage.

24. The cam of claim 22, comprising at least one weight of a material with a specific gravity different than the material of said cam body, wherein said weight is mounted to said cam body offset from the midpoint of said axle passage and wherein the center of mass axis of said weight with respect to the cam plane is substantially coaxial with said axle passage.

* * * * *